United States Patent [19]

Liebermann

[11] 4,144,926

[45] Mar. 20, 1979

[54] CRITICAL GAS BOUNDARY LAYER REYNOLDS NUMBER FOR ENHANCED PROCESSING OF GLASSY ALLOY RIBBONS

[75] Inventor: Howard H. Liebermann, Schenectady, N.Y.

[73] Assignee: General Electric Company, Schenectady, N.Y.

[21] Appl. No.: 896,752

[22] Filed: Apr. 17, 1978

[51] Int. Cl.[2] ..... B22D 11/06

[52] U.S. Cl. ..... 164/87

[58] Field of Search ..... 164/87, 423, 427, 82; 264/164, 165, 176 F

[56] References Cited

U.S. PATENT DOCUMENTS 3,881,540 5/1975 Kavesh ..... 164/87

3,881,542 5/1975 Polk et al. ..... 164/87

FOREIGN PATENT DOCUMENTS 2719710 11/1977 Fed. Rep. of Germany ..... 164/423

*Primary Examiner*—Richard B. Lazarus

*Assistant Examiner*—K. Y. Lin

*Attorney, Agent, or Firm*—Donald M. Winegar; Joseph T. Cohen; Charles T. Watts

[57] ABSTRACT

A critical gas boundary layer Reynolds number has been defined to indicate conditions under which glassy alloy ribbons with serrated edges and surface perforations result when processing under various gaseous atmospheres and pressures.

2 Claims, 4 Drawing Figures

| SAMPLE UNDERSIDE | Re | GAS | P, mm Hg | w, mm |
|---|---|---|---|---|
| | 4 | air | 0.5 | 2.9 |
| | 920 | Kr | 50 | 2.8 |
| | 1700 | Xe | 50 | 3.0 |
| | 2500 | Ar | 400 | 1.8 |
| | 4200 | Ar | 600 | 2.0 |
| | 5000 | Xe | 150 | 3.0 |
| | 7000 | air | 760 | 3.0 |
| | 9300 | air | 760 | 4.0 |

CRITICAL GAS BOUNDARY LAYER REYNOLDS NUMBER FOR ENHANCED PROCESSING OF GLASSY ALLOY RIBBONS

BACKGROUND OF THE INVENTION

1. Field of the Invention

This invention relates to producing glassy alloy ribbons by chill block melt-spinning and in particular to a critical gas boundary layer Reynolds number above which glassy alloy ribbons with serrated edges and surface perforations result.

2. Description of the Prior Art

Relationships between processing parameters and dimensions of glassy alloy ribbons formed by melt-spinning have been discussed by Chen and Miller in Material Research Bulletin 11, 49 (1976), Liebermann and Graham, Jr., I.E.E.E. Transactions Mag-12, No. 6, 921 (1976) and Kavesh, Metallic Glasses, ed. J. J. Gilman, A.S.M. (1978), Ch. 2. However, the nature of the gas boundary layer associated with the motion of the substrate wheel and its effects on the melt puddle and resultant ribbon geometry have not been quantitatively considered in the literature. Although relatively narrow glassy alloy ribbons may be cast satisfactorily without special care regarding the prevalent atmosphere in which melt-spinning is conducted, the fabrication of wider ribbons with good surface finish and smooth edges is found to be difficult or impossible without controlling the gas boundary layer on the circumferential surface of the rotating substrate wheel. Failure to control this boundary layer typically results in ribbons with serrated edges and possible longitudinal slits.

It is therefore an object of this invention to provide a new and improved method for processing glassy alloy ribbons.

Another object of this invention is to provide a new and improved method for processing glassy alloy ribbons wherein substantially higher than prior art substrate speeds are employed in the manufacture of very thin ribbons.

A further object of this invention is to provide a new and improved method for processing glassy alloy ribbons embodying a critical gas boundary layer Reynolds number for developing casting parameters.

Other objects of this invention will, in part, be obvious and will, in part, appear hereinafter.

BRIEF DESCRIPTION OF THE INVENTION

In accordance with the teachings of this invention there is provided a method for producing glassy alloy ribbons. The method includes controlling the thin gas boundary layer established on the rapidly moving substrate surface immediately adjacent to the melt puddle from which the ribbon is produced. The melt puddle is produced by impinging a molten alloy jet onto the circumferential surface of a rotating substrate wheel of diameter D. The substrate wheel speed S, the melt jet velocity resulting in a melt puddle of width w on the substrate wheel surface, and the ambient atmospheric pressure P are adjusted to predetermined values. The glassy alloy ribbon is produced from the melt puddle while maintaining the Reynolds number Re for the gas boundary layer flow about the melt puddle less than a critical value $Re^{crit}$ of about 2000 ± 100. The gas boundary layer Reynolds number is expressed by the following formula:

$$Re = KDSwP\,[\overline{M}/\eta]$$

wherein

Re = Reynolds number

K = constant which takes into consideration all conversion factors to obtain dimensional consistency D = substrate wheel diameter S = substrate wheel speed w = ribbon or puddle width P = ambient atmospheric pressure under which casting is conducted $\overline{M}$ = molecular weight of ambient gas in which casting is conducted $\eta$ = viscosity (20° C.) of ambient gas in which casting is conducted The value of K is $2.868 \times 10^{-9}$ when D and w are each expressed in centimeters, S is expressed in revolutions per minute, P is expressed in millimeters of mercury, $\overline{M}$ is expressed in grams per gram-mole, and $\eta$ is expressed in poise.

DESCRIPTION OF THE INVENTION

It has been discovered that in the casting of glassy alloy ribbons (commonly referred to as amorphous ribbons) in various types of gaseous atmospheres and at various pressures ribbon edge deterioration invariably occurred at gas boundary layer Reynolds numbers of > 2000 ± 100 and was not necessarily dependent on ribbon width. The various gases in which the ribbon was cast were helium, air, carbon monoxide, argon, krypton and xenon.

The critical Reynolds number of the gas boundary layer interacting with the melt puddle is expressed as follows:

$$Re^{crit} = KDSwP\,[\overline{M}/\eta] \approx 2000 \qquad \text{(I)}$$

where

Re = Reynolds number

K = constant which takes into consideration all conversion factors to obtain dimensional consistency D = substrate wheel diameter S = substrate wheel speed w = ribbon (puddle) width p = ambient atmospheric pressure under which casting is conducted $\overline{M}$ = molecular weight of ambient gas in which casting is conducted $\eta$ = viscosity (20° C.) of ambient gas in which casting is conducted Preferably, Re < ≈ 2000 ± 100 in order that ribbon edge deterioration and surface perforations are avoided and the product is useable for product manufacture.

A thin boundary layer in which the gas molecules essentially move with the same velocity as the casting surface of a substrate wheel, upon which a melt is cast, is established because of frictional forces between the substrate surface and the adjacent gas molecules. It is the nature of this thin boundary layer and its interaction with the alloy melt puddle, from which glassy alloy ribbon is continuously drawn, which determines whether or not serrated ribbon edges and surface perforations will occur under a given set of casting conditions.

Figure 1:
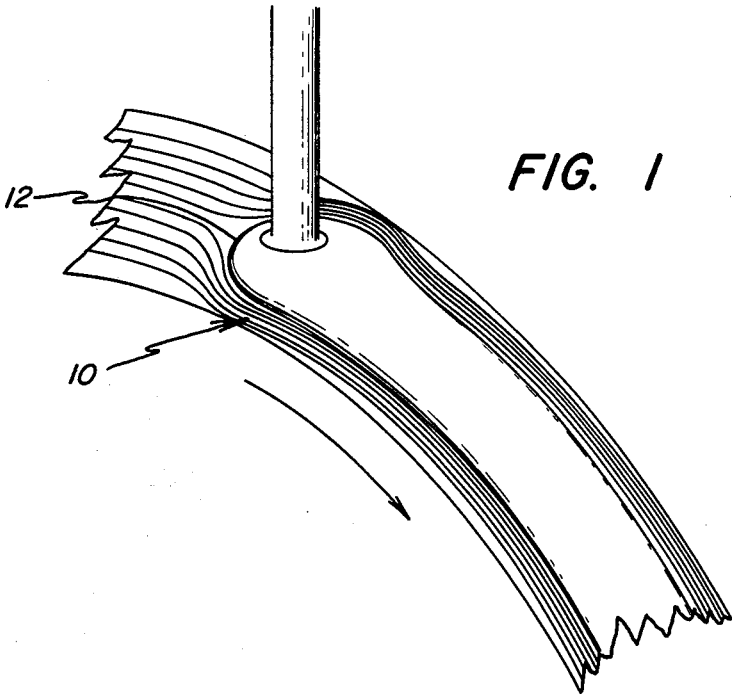
FIG. 1 is a schematic of ribbon formation with gas boundary Reynolds number less than a critical value $Re^{crit}$.
Figure 2:
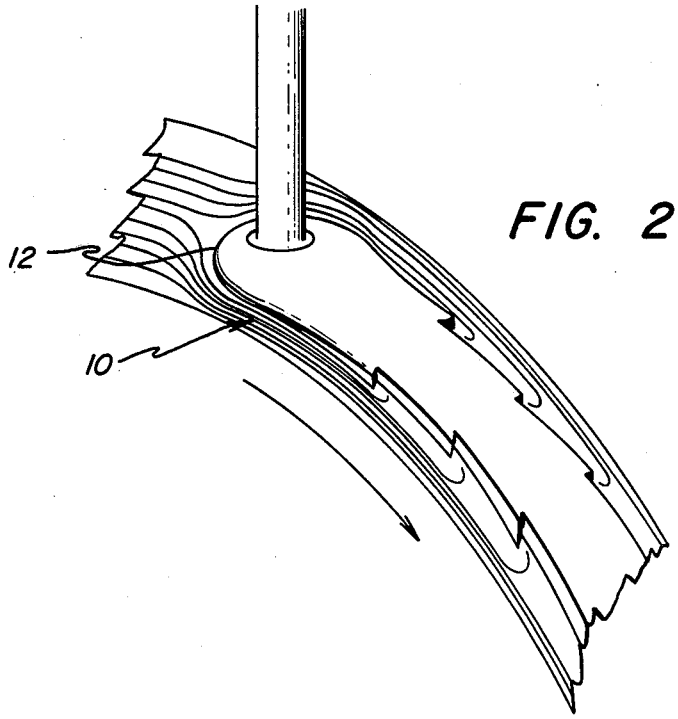
FIG. 2 is a schematic of ribbon formation with gas boundary layer Reynolds number greater than a critical value $Re^{crit}$.

With reference to FIG. 1, the thin gas boundary layer 10 following the moving substrate surface and immediately adjacent to the melt puddle at its interface with the substrate surface 12 does not adversely affect changes in the melt puddle width. The thin gas flow boundary layer 10 remains nonturbulent for a gas boundary layer Reynolds number Re less than some critical value $Re^{crit}$. Referring now to FIG. 2, turbulence occurs in the thin boundary layer 10 when $Re > Re^{crit}$ and modulates melt puddle width, thereby causing serrated edges.

The gas boundary layer Reynolds number appears to follow the relationship:

$$Re = vw/\nu \quad \text{(II)}$$

wherein

Re = the Reynolds number v = gas velocity (assumed equal to substrate surface velocity)

w = ribbon width (assumed equal to melt puddle width at interface with the substrate wheel)

$\nu = \eta/\rho$ = kinematic gas viscosity and $\eta$ = static gas viscosity $\rho$ = gas density Assuming ideal gas behavior, $$\rho = n\overline{M}/V = P\overline{M}/RT \quad \text{(III)}$$

wherein n = moles of gas $\overline{M}$ = gas molecular weight

V = gas volume

P = gas pressure

R = ideal gas constant

T = gas temperature by substitution:

$$Re = [vwp/RT\,\pi]\cdot[\overline{M}/\eta] \quad \text{(IV)}$$

The first of the two factors of equation (IV) relates exclusively to physically variable apparatus and processing parameters. The second factor of equation (IV) is a physical constant particular to gas in which the melt-spinning is conducted. The following Table records the physical constant and propensity for serrated edge formation for various gases, all of which have been used in melt-spinning experiments except for $H_2$ and Ne.

TABLE

| Gas | He | $H_2$ | Ne | Air | CO | Ar | $CO_2$ | Kr | Xe |
|---|---|---|---|---|---|---|---|---|---|
| $10^{-4}\frac{\overline{M}}{\eta}$ | 2.06 | 2.30 | 6.49 | 15.8 | 16.0 | 18.1 | 29.7 | 34.1 | 58.1 |

order of increased propensity for serrated ribbon edge formation

——————————————————————>

Figure 3:
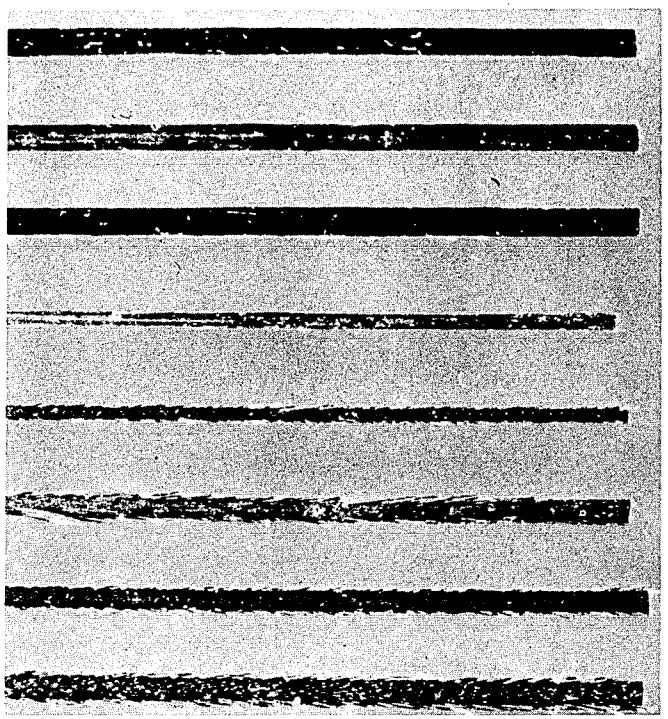
FIG. 3 is a photograph of glassy alloy ribbons produced with various gas boundary layer Reynolds numbers using a 7.5 cm diameter substrate wheel rotating at 9000 rev/min.

With reference to FIG. 3, glassy alloy ribbons of $Fe_{40}Ni_{40}B_{20}$ were produced under various gas boundary layer Reynolds numbers. The ribbon edge deterioration occurred abruptly at Re = ≈ 2000. Ribbon edge and surface deterioration intensified with an increasing gas boundary layer Reynolds number.

Figure 4:
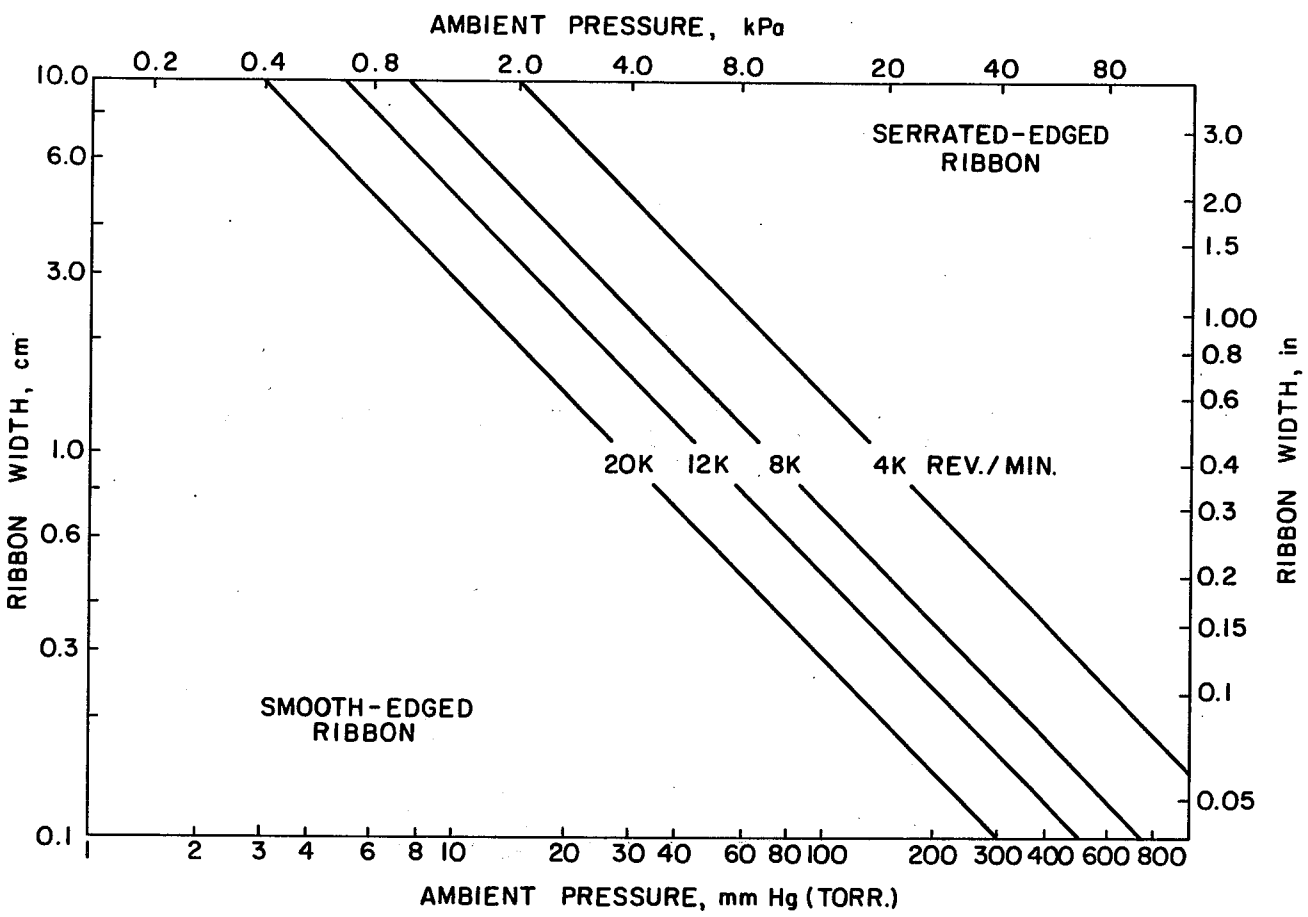
FIG. 4 is a graphical representation of critical processing conditions required for producing glassy alloy ribbons without serrated edges in air at 20° C. on a substrate wheel of 7.5 cm diameter.

By application of Equation (I) one is able to determine apparatus and processing conditions necessary for the fabrication of uniform wide glassy alloy ribbons with smooth edges. Glassy alloy ribbons in the systems such as Fe-B, Fe-B-C, Fe-Ni-B, Fe-B-Si, Nb-Ni, Cu-Ti, Ni-Zr, and Cu-Zr are successfully cast with smooth edges when the processing parameters conform to the limitations expressed in Formula (I). The following is an example of the manner in which equation (I) may be used to define processing parameters for the fabrication of glassy alloy ribbons with good, uniform geometry. If glassy alloy ribbon is melt-spun at 20° C. using a substrate wheel diameter of 7.5 cm, the critical ambient atmospheric pressure for casting the glassy alloy ribbon of given width with good edges in air at several substrate wheel speeds is given in the graph of FIG. 4. The use of ambient atmospheric pressure greater than critical will cause the gas boundary layer Reynolds number to become hypercritical and serrated-edge ribbon will result.

EXAMPLE I

Glassy Alloy Ribbon Manufacture With $Re > Re^{crit}$

A glassy alloy ribbon of nominal composition $Fe_{40}Ni_{40}B_{20}$ 3 millimeters in width was produced by casting on the surface of a substrate wheel 7.5 centimeters in diameter rotating at a speed of 9000 revolutions per minute. The ambient atmosphere was xenon at 150 millimeter mercury pressure. The gas boundary layer Reynolds number, Re, as determined from equation (I) was 5000. The ribbon edges were serrated and the ribbon surface showed fine perforations.

EXAMPLE II

Glassy Alloy Ribbon Manufacture With $Re < Re^{crit}$

A glassy alloy ribbon of nominal composition $Fe_{80}B_{18}Si_2$ 7 millimeters in width was produced by casting on the surface of a substrate wheel 7.5 centimeters in diameter rotating at a speed of 10000 revolutions per minute. The ambient atmosphere was air at 70 millimeters mercury pressure. The gas boundary layer Reynolds number, Re, as determined from equation (I) was 1700. The ribbon edges were smooth and both the top and bottom surfaces were of excellent quality.

EXAMPLE III

Glassy Alloy Ribbon Manufacture With $Re << Re^{crit}$

A glassy alloy ribbon of nominal composition $Fe_{40}Ni_{40}B_{20}$ 2.5 centimeters in width was produced by casting on the surface of a substrate wheel of 25 centimeters diameter rotating at a speed of 3000 revolutions per minute. The ambient atmosphere was air at 0.10 millimeters mercury pressure. The gas boundary Reynolds number, Re, as determined from equation (I) was 8. The ribbon edges were smooth and both the top and bottom surfaces were of excellent quality.

I claim:

1. A method for producing glassy alloy ribbons including the process steps of (a) casting a melt of a glassy metal alloy onto a surface wheel having a wheel diameter D;

(b) adjusting the substrate wheel speed S and the melt jet velocity to form a melt puddle of width w on the substrate wheel surface;

(c) adjusting the prevalent ambient atmospheric pressure to a predetermined value;

(d) producing a glassy alloy ribbon from the melt puddle, and (e) maintaining the Reynolds number Re for the gas boundary layer flow about the melt puddle at less than a critical value $Re^{crit}$ of about 2000 ± 100 whereby the Reynolds number Re is expressed by the following formula:

$$Re = KDSwP\,[\overline{M}/\eta\,]$$

wherein

Re = Reynolds number

K = constant which takes into consideration all conversion factors to obtain dimensional consistency D = substrate wheel diameter S = substrate wheel speed w = ribbon or puddle width P = ambient atmospheric pressure under which casting is conducted $\overline{M}$ = molecular weight of ambient gas in which casting is conducted $\eta$ = viscosity (20° C.) of ambient gas in which casting is conducted

2. The method of claim 1 wherein $$K = 2.868 = 10^{-9} \quad \text{when}$$

D and w are expressed in centimeters, S is expressed in revolutions per minute, P is expressed in millimeters of mercury, $\overline{M}$ is expressed in gram per gram mole, and $\eta$ is expressed in poise.

* * * * *

UNITED STATES PATENT AND TRADEMARK OFFICE

CERTIFICATE OF CORRECTION

PATENT NO. : 4,144,926

DATED : March 20, 1979

INVENTOR(S) : Howard H. Liebermann

It is certified that error appears in the above-identified patent and that said Letters Patent are hereby corrected as shown below:

Column 3, line 47, "$Re = \left[vwp/RT\pi\right] \cdot \left[\bar{M}/\eta\right]$" should read -- $Re = \left[\frac{vwP}{RT}\right] \cdot \left[\frac{\bar{M}}{\eta}\right]$ --

Signed and Sealed this

*Fourteenth* Day of *August 1979*

[SEAL]

*Attest:*

*Attesting Officer*

LUTRELLE F. PARKER

*Acting Commissioner of Patents and Trademarks*